United States Patent [19]

Kurz

[11] Patent Number: 4,583,987

[45] Date of Patent: Apr. 22, 1986

[54] METHOD FOR DYEING AND LUBRICATING SEWING THREADS IN A SINGLE BATH AND SUITED COMPOSITIONS FOR FINISHING

[76] Inventor: Jürgen Kurz, Im Bruhl 30, D-7409 DuBlingen, Fed. Rep. of Germany

[21] Appl. No.: 694,851

[22] Filed: Jan. 25, 1985

[30] Foreign Application Priority Data

Jan. 4, 1985 [DE] Fed. Rep. of Germany ..... 3500168

[51] Int. Cl.[4] ..... D06M 15/66; D06P 5/00

[52] U.S. Cl. ..... 8/495; 8/494; 8/532; 8/918; 8/922; 8/924; 252/8.6; 252/8.8; 252/8.9

[58] Field of Search ..... 8/495, 494; 252/8.6, 252/8.8, 8.9

[56] References Cited

U.S. PATENT DOCUMENTS

| | | | |
|---|---|---|---|
| 3,896,032 | 7/1975 | Stroh et al. | 252/8.6 |
| 3,963,628 | 6/1976 | Park | 252/8.8 |
| 4,076,672 | 2/1978 | Huber et al. | 252/8.6 |
| 4,171,267 | 10/1979 | McAfee et al. | 252/8.6 |
| 4,217,228 | 8/1980 | Koerner et al. | 252/8.6 |
| 4,340,383 | 7/1982 | Rohser | 8/494 |
| 4,451,382 | 5/1984 | Childers | 252/8.6 |
| 4,501,588 | 2/1985 | Suzuki et al. | 8/444 |
| 4,501,590 | 2/1985 | Suzuki et al. | 8/495 |

*Primary Examiner*—A. Lionel Clingman

*Attorney, Agent, or Firm*—Cushman, Darby & Cushman

[57] ABSTRACT

This invention relates to a method of dyeing and lubricating sewing thread simultaneously including suited compositions which, in the main, consist of a combination of dispersions of silicone oils, waxes, and fatty acid condensation products.

11 Claims, No Drawings

METHOD FOR DYEING AND LUBRICATING SEWING THREADS IN A SINGLE BATH AND SUITED COMPOSITIONS FOR FINISHING

BACKGROUND OF THE INVENTION

The present invention relates to a method for the finish (lubricating) of sewing threads of synthetic yarns, natural yarns, or core yarns (e.g., of polyester and cotton), included the suited lubricating agents.

It is known to treat sewing threads with lubricants containing diorganopolysiloxanes as heat protecting agent and paraffin waxes as gliding agents,* for example from DE-OS 21 61 813 and 25 35 768. The techniques applied for this finish are manifold. To date, the lick roller method (DE-OS 21 62 417 and 27 08 650), the dip method (DE-OS 27 53 200), and the exhaust method (DE-OS 28 16 196 and 31 15 679) are known.

*DE-OS=German Disclosure Document

As disadvantages of the individual methods should be mentioned the laborious lubricating process at the single threads in the lick roller process, the limited reusability of the dip liquors in case of the dip process and the necessity of warming and exact adjustment of the ph-value in the exhaust method.

Moreover, all conventional lubricating processes have one common disadvantage: after completion of the dyeing phase, they require an additional processing step.

SUMMARY OF THE INVENTION

The object of the present invention is to provide a method for the finish of sewing threads of synthetic yarns, natural yarns, and core yarns (e.g., of PES and cotton), which is characterized in application of the lubricating agents in the dyebath and simultaneous dyeing and lubricating in a single processing step. The above exhibited disadvantages of the previously known sewing thread finishing methods are not encountered with the method of the present invention.

The method of the present invention is made possible by a special composition of the lubricating agent applied therein, as is illustrated hereinbelow.

The applicant has found that the lubricants according to the claim, applied in the dyebath (dyestuff containing bath), do not at all interfere with the dyeing process, the exhaust of the dyestuff, and the fastnesses of the dyed yarns. This is the more surprising as the bath contains anionic and cationic components. The threads simultaneously dyed and lubricated in a single bath surprisingly meet with all requirements on the quality standard which, up to now, was reached in two or more processing steps. In this way, the invention enables very economic processing by saving time and one or several treatment baths.

In the following, the invention is further illustrated.

Yarns of synthetic nature are, for example, polyester yarns (PES) and polyamide yarns (PA), such as PA 6.6. Natural yarns are, for example, cotton yarns (co). Core yarns may be composed of polyester (PES) and cotton (co).

The especially suited lubricants for the method of the present invention are characterized in containing the following components, dispersed or dissolved in water:

(a) 1 to 80 weight percent silicone oil of 500 to 100,000 mPa·s viscosity, at 25° C.;

(b) 1 to 50 weight percent vegetable wax, animal wax, montan wax, wax of mineral oil (particularly paraffin) and/or polyolefin-wax, each wax having a melt point of ≧35° C;

(c) 0 to 20 weight percent of a quaternary ammonium compound of the formula

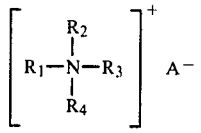

$R_1$=alkyl $C_{12}$–$C_{22}$
$R_2$=alkyl $C_1$–$C_{22}$
$R_3$=alkyl $C_1$–$C_{22}$
$R_4$=alkyl $C_1$–$C_4$
A=salt forming anion and/or a diquaternary ammonium compound of the formula

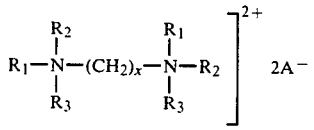

wherein $R_1$, $R_2$, $R_3$, $R_4$, and A are as defined above, and x means 2 or 3, and/or an alkylimidazolinium salt with alkyl groups of 12 to 22 carbon atoms;

(d) 1 to 10 weight percent of a fatty acid condensation product, composed of $C_{12}$–$C_{22}$ fatty acids and alkanolamines or polyamines, in form of a salt;

(e) 0 to 5 weight percent amine oxide of the formula

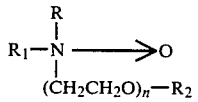

wherein R is $C_{8-12}$-alkyl or $C_8$–$C_{12}$-alkenyl, $R_1$ is $C_{1-4}$-alkyl, $R_2$ is H or C or $C_{1-4}$-alkyl, and n means figures from 0 to 6;

(f) 1 to 10 weight percent of non-ionic emulsifiers, basis $C_{12}$–$C_{22}$-fatty aLcohols or -fatty acids or isotridecyl fatty acid ester with each 2 to 50 moles of added ethylene oxide (EO);

(g) 0 to 10 weight percent non-ionic emulsifiers based on ethoxylated triglycerides;

(h) 0 to 10 weight percent cationic emulsifiers, basis $C_{12}$–$C_{22}$ fatty amines with 2 to 30 moles of added ethylene oxide (EO).

The beforementioned data in weight percent refer each to the lubricant in form of the aqueous dispersion. The following explanations apply to the individual components (a) to (h).

Component (a): in general, its amount ranges between 1 to 80 weight percent, preferably 5 to 50 weight percent and most preferably 20 to 40 weight percent. As silicone oil, for example, a methyl silicone oil (especially dimethylpolysiloxane) of 500 to 100,000 mPa·s viscosity, preferably 2000 to 30,000 mPa·s, each at 25° C., can be named. The silicone oil may also contain short-chain alkyl groups (such as, for instance, ethyl- or propyl groups) and/or phenyl groups as substituents. The chain ends are formed by trimethylsilyl groups and, to a limited number, also by dimethylhydroxysilyl groups.

The amount of silicone oil in the compositions according to the invention is dependent on the type of the sewing thread to be treated. For synthetic yarns, the finish is allowed to contain a high portion of silicone oil (e.g., 20 to 50 weight percent). For sewing threads which mainly, or at least on their surfaces, consist of natural fiber material, lubricants can be used which silicone portion is reduced in favor of the wax portion, the composition may then contain, e.g., 1 to 20 weight percent, preferably 1 to 5 weight percent, of silicone oil.

Component (b): its amount generally ranges between 1 to 50 weight percent, preferably 1 to 20 weight percent and most preferably 2 to 10 weight percent. The waxes according to claim have a melt point of ≧35° C. each. Examples for vegetable waxes are, especially, carnauba wax and jojoba oil. Examples for animal waxes are, especially, beeswax and lanolin. Montan waxes are, for example, ester waxes and acid waxes produced by resin finishing montan waxes. Within the group of waxes deriving from mineral oil, the paraffin waxes are particularly worth mentioning. Polyolefin waxes are, for example, high-density polyethylene wax oxidates and low-density polyolefin wax oxidates.

Fully refined paraffins (oil content: e.g., 0.5 weight percent, color: pure white, smell: none) and/or semi-refined paraffins (oil content: e.g., 1.0 to 2.5 weight percent, color: pure white, smell: weak) as described in "Ullmanns Enzyklopadie der technischen Chemie", volume 24, Editions Chemie GmbH, D-6940 Weinheim, in 1980, are preferred.

Preferred gliding agents are also macrocrystalline paraffins (paraffin waxes) having a melt range of 40° to 65° C. Microcrystalline paraffins (microwaxes) with a higher melting point may also be taken into account. These are then preferably mixed with low melting paraffins; in this case, mixtures of 10 to 30 parts by weight of low melting paraffins and 90 to 70 parts by weight of higher melting paraffins are especially mentionable. It is also possible to apply mixtures of different wax types.

Component (c): the amount of this possibly present component generally ranges between 0 and 20 weight percent, preferably 0 to 10 weight percent. Within the alkyl chain length of $R_1$, according to the claim, alkyl residues with $C_{12}$–$C_{14}$, $C_{16}$–$C_{18}$, and $C_{22}$ are preferred. For the alkyl chain lengths of $R_2$ and $R_3$, alkyl residues of $C_1$, $C_2$, $C_{12}$–$C_{14}$ and $C_{16-18}$ are especially considered. As alkyl chain lengths of $R_4$, especially methyl and ethyl are preferred. Examples for salt forming anions A are mainly chlorides and metho-and ethosulates. Within the group of $C_{12}$–$C_{22}$ alkyl residues of the alkylimide azolin salts in accordance with the claim, alkyl residues with $C_{12}$–$C_{14}$, $C_{16}$–$C_{18}$, and $C_{22}$ can be mentioned as examples.

Component (d): in general, its amount ranges from 1 to 10 weight percent, especially 1 to 6 percent. As $C_{12}$–$C_{22}$-fatty acid-component (of the fatty acid condensation products), those with $C_{12}$–$C_{14}$, $C_{16}$–$C_{18}$ and $C_{22}$ can be mentioned as examples, especially stearic acid or behenic acid. An alkanol amine is, e.g., triethanolamine, a polyamine is, e.g., dimethylaminopropylamine. The salts can be formed with inorganic acids or low organic carboxylic acids or low hydroxycarboxylic acids. Preferred salts of the acids are chlorides, sulfates, formiates, acetates, and lactates.

Components (e): examples for the alkyl residues of $R_1$ and $R_2$ of this possibly present component are, in particular, methyl and ethyl. Preferred meaning of n is 0, 1, and 2.

Components (f): this component is usually present in an amount of 1 to 10 weight percent, preferably 1 to 5 weight percent. The chain length of the indicated fatty alcohol-, fatty acid-, or fatty acid ester component is, for example $C_{12}$–$C_{14}$ or $C_{16}$–$C_{18}$. Within the group of ethylene oxide addition products those containing 15 to 25 moles EO are preferred. Component (f) may especially be stearyl alcohol×50 EO and isotridecyl stearate×2 EO.

Components (g); if desired, this component is usually present in an amount of 0 to 10 weight percent, preferably 0 to 5 weight percent. Just an example for the group according to the claim is caster oil×8 EO.

Component (h): in general, the amount of this possibly present component ranges between 0 to 10 weight percent, preferably 0 to 5 weight percent. Within the group of fatty amines those with $C_{12}$–$C_{14}$- or with $C_{16}$–$C_{18}$ -alkyl groups are to mention as examples. Preferred ethylene oxide addition products are those with 2 to 10 moles of ethylene oxide. Just examples for the component (h) are oleylamine×2 EO and stearylamine×5 EO.

The components (c), (d), and (e) accomplish various functions, which are dependent on whether the thread is of synthetic, natural, or core yarn. In the compositions according to the present invention, they act on one hand as antielectrostatics, as softener, and in synergism to the waxes as gliding agent, too, on the other hand they have a stabilizing effect, act as co-emulsifiers and promote uniform exhaust performance of the compositions during dyeing.

The component (f), (g), and (h) act as emulsifiers on production of the dyebath lubricants, promote the antielectrostatic efficiency of the auxiliaries described and have a stabilizing effect on the agents applied in the individual dyeing liquors.

The lubricants in accordance with the present invention can be produced in different ways. They are preferably produced in the way that the components (a) and (b) are emulsified separately and emulsifier (f) may be applied alone or with the emulsifiers (g) and/or (h). The components (c), (d), and (e) are preferably emulsified in association with the component (b).

The resultant dispersions of (a) and (b) can be blended after completion, or the emulsion of component (b) can be used to complete emulsification of a pre-emulsion of component (a). The outer phase of the agents described herein is water, i.e., these are oil-in-water-emulsions (O/W-emulsion).

The emulsions may either be produced without pressure (water-in-wax-process or wax-in-water-process) or in a low pressure autoclave. For optimum stable dyeing liquors, it is advantageous to homogenize the compositions, for example, by pumping the blends through a colloid mill and/or a high-pressure homogenizer.

The lubricant in accordance with the invention can be applied in the dyebath in different amounts. An advantageous lubricant amount are 5 to 25 weight percent, especially 10 to 20 weight percent of the weight of the material to be dyed.

For details which should be taken into account when dyeing sewing threads of synthetic, natural, and core yarns in actual practice, reference may be made to relevant chemical literature and the shade cards of the dyestuff manufacturers. Therefore, the dyestuff classes usual for sewing threads are mentioned as summary, only. These are for polyester the usual disperse dyes, for polyamide 6.6 the usual acid dyes but also usual 1:2 metal complex dyes and, for light shades, occasionally the usual disperse dyes, too; for PES/cotton mixtures of usual disperse and reactive dyes or usual dyes and for cotton the class of usual reactive and vat dyes. The dyeing liquor may contain (in addition to the dyestuffs) the normal dyeing auxiliaries such as, for instance, dispersing- and levelling agents and additives as well as carriers.

The lubricant dispersions are applied, as normal, in usual package dyeing machines as used for dyeing textile yarns. It is preferably treated at liquor ratios from 1:4 to 1:50, particularly 1:4 to 1:15, and at temperatures from 40° to 140° C., preferably 100° to 140° C.

The following examples further illustrate the invention, however, are not intended to limit its application in any way.

The marking (*) with the disperse dyestuff in Example 1, FIG. 2, and with the disperse/vat dyestuff in Example 2 FIG. 2 means that each applicable dyestuff amount is dependent on the shade desired; matching of this dyestuff amount is known to dye specialists and may be taken from the shade cards of the dye manufacturers.

DETAILED DESCRIPTION

Example 1

1. Composition of the finish (lubricant) in accordance with the present invention

| | | |
|---|---|---|
| (a) | 35.0 weight percent | dimethylpolysiloxane (20,000 mPa · s) |
| (b) | 8.0 weight percent | paraffin wax, Mp. 58 to 60° C. |
| (c) | 3.0 weight percent | of a 1:1 condensate of behenic acid and dimethyaminopropylamine in form of the chloride |
| (d) | 1.5 weight percent | stearyl alcohol × 50 EO (ethylene oxide) |
| (e) | 1.5 weight percent | castor oil × 8 EO |
| (f) | 1.0 weight percent | oleylamine × 2 EO |
| (g) | 50.0 weight percent | demineralized water |

2. Application of the finish according to the present invention

PES-sewing thread of filament yarn, textile fiber yarn (cotton- or schappe-spun) or textured yarn is first precleaned in the usual way, according to the following recipe, for example:

1 to 2 g/l non-ionic washing agent
0.5 to 1 g/l calcined soda ash
20 min. 50° to 60° C.
rinse 10 min. at 40° C.
rinse 10 min. at 20° C.

Then, the dye and lubricating liquor is set in one bath as follows:

| | |
|---|---|
| x | disperse dyes* |
| 1 to 2 g/l | anionic levelling and penetrating agents for dyes |
| 0.5 to 1 g/l | carrier |
| 0.5 g/l | anionic dispersing agent |
| 10 to 15% | finish in accordance with the invention |

pH 4.5 to 5.5 with acetic acid

For cheeses, the liquor is preferably pumped reciprocally through the yarn package and/or cones, e.g., 4 min. outside-inside and 2 min. inside-outside.

Treat 5 min. at about 40° C., raise temperature to 130–135° C., 1.5 to 2°/min., (HT-conditions, i.e., high temperature conditions), dye at 130–135° C. for 30–60 min., ht-blowoff or cooling, rinse twice for 3 minutes at 80° C.

If desired, in case of dark shades, a reductive clearing treatment is carried out with 1 to 2 g/l non-ionic levelling- and dispersing agent
3 to 6 ml/l sodium hydroxide, 38° C. 3 to 6 g/l hydrosulphite
20 min. at 90° C., rince hot twice, rinse warm twice, possibly neutralize to pH 5.5.

The dyebath is perfectly stable. There is no precipitate formation between the slightly cationic preparation according to the present invention and the anionic dispersing- and levelling agents and additives. The color fastness and the fastness to rubbing fully come up to the usually high demands in the sewing thread sector. The sewing thread is completely finished, has the required gliding and sewing properties, and does not require any additional lubricating prior to winding to the final cone.

Example 2

1. Composition of the finish (lubricant) in accordance with the present invention See Example 1.1

2. Application of the finish according to the present invention

PES/cotton sewing thread of core yarn, consisting of a PES-filament core and a cotton surface is pre-cleaned in the usual way (e.g., according to Example 1.2), if necessary with the addition of 1 g/l of an anionic sequestrant and, as described in the following, is subsequently dyed and lubricated simultaneously in a single processing step: as example, a mixture of disperse and vat dyestuffs was chosen.

As usual, pre-run 0.5 to 1 g/l of an anionic levelling and penetrating agent for dyes at pH 4.5 to 5.5 (acetic acid) for 5 minutes at about 40° C. Then add

| | |
|---|---|
| x/y | % disperse/vat dyestuff* |
| and | |
| 10 to 15% finish in accordance with the invention. | |

Set liquor circulation to 4 min. outside-inside, 2 min. inside-outside (see Example 1.2), raise temprarture by 1.5 to 2°/min. to 130°–135° C. (ht-conditions) dye for 30 to 45 min. at 130–135° C., cool down, vat and oxidize subsequently as prescribed for vat dyestuffs (which are applied).

The dyebath is perfectly stable. The sewing thread comes fully up to the normal demands on quality and does not require any additional lubricating prior to winding to the final cone.

Example 3

1. Composition of the finish (lubricant) in accordance with the present invention

| | | |
|---|---|---|
| (a) | 35.0 weight percent | dimethylpolysiloxane (12,500 mPa · s) |
| (b) | 5.0 weight percent | paraffin wax, mp. 54 to 56° C. |
| (c) | 1.5 weight percent | paraffin wax, mp. 44 to 46° C. |
| (d) | 4.5 weight percent | of a 2:1 condensate of stearic acid and triethanolamine, in form of the sulfate |
| (e) | 2.5 weight percent | isotridecylstearate × 2 EO |
| (f) | 1.5 weight percent | stearylamine × 5 EO |
| (g) | 50.0 weight percent | demineralized water |

2. Application of the finish according to the present invention

As described in Examples 1 and 2, the finish is also applied as lubricant in the dyebath of sewing threads of synthetic yarns, natural yarns, and core yarns and enables simultaneous dyeing and lubricating in a single processing step.

What is claimed is:

1. A method for finishing sewing threads of synthetic yarns, natural yarns of core yarns with a lubricating agent, comprising applying the lubricating agent in the dyebath and simultaneously dyeing and lubricating in a single process step wherein the lubricating agent comprises the following components dispersed or dissolved in water:

(a) 1 to 80 weight percent silicone oil of viscosity 500 to 100,000 mPa·s at 25° C.;

(b) 1 to 50 weight percent vegetable wax, animal wax, montan wax, mineral wax or polyolefin-wax, or a mixture of such waxes, each wax having a melting point of ≧35° C.;

(c) 0 to 20 weight percent of a quaternary ammonium compound of the formula

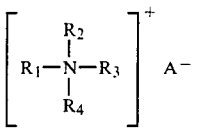

$R_1$=alkyl $C_{12}$–$C_{22}$
$R_2$=alkyl $C_1$–$C_{22}$
$R_3$=alkyl $C_1$–$C_{22}$
$R_4$=alkyl $C_1$–$C_4$
A=salt forming anion and/or a diquaternary ammonium compound of the formula

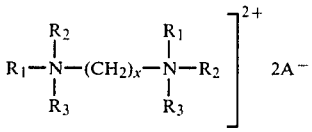

wherein $R_1$, $R_2$, $R_3$, and A are as defined above and x is 2 or 3, and/or an alkylimidazolinium salt with an alkyl group of 12 to 22 carbon atoms;

(d) 1 to 10 weight percent of a fatty acid condensation product of a $C_{12}$–$C_{22}$ fatty acid and an alkanolamine or polyamine in the form of a salt;

(e) 0 to 5 weight percent amine oxide of the formula

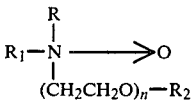

wherein R is $C_{8-12}$-alkyl or $C_{8-12}$-alkenyl, $R_1$ is $C_{1-4}$-alkyl, $R_2$ is H or $C_{1-4}$-alkyl and n is a number from 0 to 6;

(f) 1 to 10 of a non-ionic ethoxylated emulsifier based on a $C_{12-22}$-fatty alcohol or a -fatty acid or isotridecyl fatty acid ester, each etherified with 2 to 50 moles of added ethylene oxide;

(g) 0 to 10 weight percent a non-ionic emulsifier based on ethoxylated triglycerides; and (h) 0 to 10 weight percent cationic emulsifier, based on a $C_{12}$–$C_{22}$-fatty amine etherified with 2 to 30 moles of added ethylene oxide.

2. A method according to claim 1 wherein the silicone oil is a dimethyl polysiloxane.

3. A method according to claim 2 wherein (b) is a paraffin wax.

4. A lubricant composition suitable for finishing threads of synthetic yarns, natural yarns, or core yarns comprising (a) 1 to 80 weight percent silicone oil of viscosity 500 to 100,000 Pa·s at 25° C., (b) 1 to 50 weight percent vegetable wax, animal wax, montan wax, mineral wax or polyolefin-wax, or a mixture of such waxes, each wax having a melting point of ≧35° C.;

(c) 0 to 20 weight percent of a quaternary ammonium compound of the formula

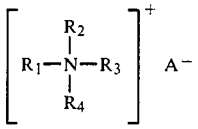

$R_1$=alkyl $C_{12}$–$C_{22}$
$R_2$=alkyl $C_1$–$C_{22}$
$R_3$=alkyl $C_1$–$C_{22}$
$R_4$=alkyl $C_1$–$C_4$
A=salt forming anion and/or a diquaternary ammonium compound of the formula

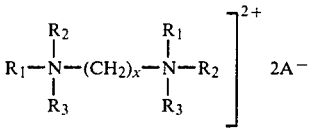

wherein $R_1$, $R_2$, $R_3$, and A are as defined above and x is 2 and 3, and/or an alkylimidazolinium salt with an alkyl group of 12 to 22 carbon atoms;

(d) 1 to 10 weight percent of a fatty acid condensation product of a $C_{12}$–$C_{22}$ fatty acid and an alkanolamine or polyamine in the form of a salt;

(e) 0 to 5 weight percent amine oxide of formula

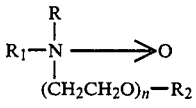

wherein R is $C_{8-12}$-alkyl or $C_{8-12}$-alkenyl, $R_1$ is $C_{1-4}$-alkyl, $R_2$ is H or $C_1$–$C_4$ alkyl and n is a number from 0 to 6;

(f) 1 to 10 weight percent of a non-ionic ethoxylated emulsifier based on a $C_{12-22}$-fatty alcohol or a -fatty acid or isotridecyl fatty acid ester, each etherified with 2 to 50 moles of added ethylene oxide;

(g) 0 to 10 weight percent a non-ionic emulsifier based on ethoxylated triglycerides; and (h) 0 to 10 weight percent cationic emulsifier, based on a $C_{12}$–$C_{22}$-fatty amine etherified with 2 to 30 moles of added ethylene oxide.

5. A lubricant composition according to claim 4 wherein (a) is a methyl silicone oil.

6. A lubricant composition according to claim 5 wherein (a) is a dimethyl polysiloxane or a methyl silicone oil also containing ethyl, propyl, or phenyl groups.

7. A lubricant composition according to claim 6 where (b) is a paraffin wax.

8. A lubricant composition according to claim 7 wherein (a) is dimethyl polysiloxane.

9. A lubricant composition according to claim 5 containing 5 to 50 weight percent (a), 1 to 20 weight percent (b) 0 to 10 weight % (c), 1 to 6 weight percent (d), 0 to 5 weight percent (e), 1 to 5 weight percent (f), 0 to 5 weight percent (g), and 0 to 5 weight percent (h).

10. A lubricant composition according to claim 5 wherein (a) has a viscosity of 2000 to 30,000 mPas, (b) is carnauba wax, jojobu oil, beeswax, lanolin, an ester wax or acid wax produced by resin finishing a montan wax, a paraffin wax, a high-density polyethylene wax oxidate or a low density polyolefin wax oxidate.

11. A lubricant composition according to claim 10 wherein (b) is paraffin wax having a melt range between 40 and 65° C.

* * * * *